US009433301B2

(12) United States Patent
Brechet et al.

(10) Patent No.: US 9,433,301 B2
(45) Date of Patent: Sep. 6, 2016

(54) FURNITURE ELEMENT, IN PARTICULAR A SEAT OR CUSHION, AND ASSOCIATED METHODS

(71) Applicants: Olivier Brechet, Le Cap Ferret (FR); Nathalie Brechet, Le Cap Ferret (FR)

(72) Inventors: Olivier Brechet, Le Cap Ferret (FR); Nathalie Brechet, Le Cap Ferret (FR)

(73) Assignee: VDJ IMPORT, Lege Cap Ferret (FR)

( * ) Notice: Subject to any disclaimer, the term of this patent is extended or adjusted under 35 U.S.C. 154(b) by 0 days.

(21) Appl. No.: 14/426,373

(22) PCT Filed: Sep. 5, 2013

(86) PCT No.: PCT/IB2013/058315

§ 371 (c)(1),
(2) Date: Mar. 5, 2015

(87) PCT Pub. No.: WO2014/037897

PCT Pub. Date: Mar. 13, 2014

(65) Prior Publication Data

US 2015/0250328 A1 Sep. 10, 2015

(30) Foreign Application Priority Data

Sep. 6, 2012 (FR) ..... 12 02384

(51) Int. Cl.

| | |
|---|---|
| ***A47C 27/08*** | (2006.01) |
| ***A47C 3/16*** | (2006.01) |
| ***A47C 4/54*** | (2006.01) |
| ***A47C 31/11*** | (2006.01) |
| ***F17C 13/00*** | (2006.01) |

(52) U.S. Cl.

CPC ..... *A47C 27/086* (2013.01); *A47C 3/16* (2013.01); *A47C 4/54* (2013.01); *A47C 27/081* (2013.01); *A47C 31/11* (2013.01); *F17C 13/00* (2013.01); *Y10T 137/0402* (2015.04)

(58) Field of Classification Search

CPC ..... A47C 4/54; A47C 5/12; A47C 27/08; A47C 27/081; A47C 27/084; A47C 27/086; A47C 27/088; A47C 27/10; A47C 3/16; A47C 31/11; F17C 13/00; Y10T 137/0402

See application file for complete search history.

(56) References Cited

U.S. PATENT DOCUMENTS

| | | | | |
|---|---|---|---|---|
| 2,942,281 | A * | 6/1960 | Cole | A47C 27/128 5/644 |
| 3,017,642 | A * | 1/1962 | Rosenberg | A47C 27/084 297/DIG. 3 |
| 4,724,560 | A * | 2/1988 | Christie | A47C 27/081 5/644 |
| 5,079,786 | A * | 1/1992 | Rojas | A47C 7/021 5/654 |

(Continued)

*Primary Examiner* — Philip Gabler

(74) *Attorney, Agent, or Firm* — Blakely Sokoloff Taylor & Zafman LLP

(57) ABSTRACT

A furniture element is characterized in that it comprises a first flexible inner envelope (30) defining therein a first volume (22) adapted to receive a material comprising a fluid with a first density and a second flexible outer envelope (10), the inner envelope and the outer envelope defining together a second volume (21) surrounding the first volume (22) and adapted to receive a second material comprising a fluid and flexible particles with a second density higher than the first density, a first closable port (40) for entry or exit of fluid into/from said first volume, opening to the outside, and a second closable port (50) for the entry or exit of fluid into/from said second volume, opening to the outside. The invention can be used in particular for improving the comfort and facilitating the transportation of large volume seat-type or cushion type elements (typically from 0.2 to 1 m2) for outdoor use (terraces, swimming pools, etc.).

18 Claims, 3 Drawing Sheets

(56) References Cited
U.S. PATENT DOCUMENTS 6,209,962 B1 * 4/2001 Sobel ..... A47C 3/16
297/452.17
6,226,820 B1 * 5/2001 Navarro ..... A47C 27/085
5/654
6,401,279 B1 * 6/2002 Vaughn ..... A47G 9/10
5/644
2004/0098806 A1 * 5/2004 Stender ..... A47C 7/021
5/654

* cited by examiner

FURNITURE ELEMENT, IN PARTICULAR A SEAT OR CUSHION, AND ASSOCIATED METHODS

FIELD OF THE INVENTION

The present invention generally relates to furniture, in particular to seats with a flexible structure.

STATE OF THE ART

Seats comprising an envelope filled with balls or pieces or chips of cell form structure material are widely known in the art, the material providing a great freedom of shape to the seats.

Depending on the nature and geometry of the envelope and on the density of the filling material, the shape of such seats is more or less free.

One can thus make ottomans, cushions, seats with a backrest, in the most various forms.

One disadvantage of these furniture elements is that they are bulky and sometimes relatively heavy, depending on the type of filler material.

Indeed, even if processes are known for creating vacuum inside the envelope, so as to reduce the volume of the furniture element for transportation, the volume gain remains fairly limited. In addition, there is no gain in weight.

Furthermore, after filling such a furniture element with the filling material, the rigidity or flexibility of the element is determined once and for all, and it is necessary to add or remove filler material to adjust this factor.

Also known are seats, mattresses, etc. comprising both a volume for containing air and a volume for containing a filling material. Documents BE413231A, U.S. Pat. No. 2,942,281A and U.S. Pat. No. 6,592,533B1 give examples of such items. However, they give no indication on the possibilities of volume reduction for handling, and do not allow reproducing the effect of a cushion which is both lightweight and relatively free in shape.

SUMMARY OF THE INVENTION

The present invention aims at overcoming all or part of the aforementioned drawbacks, and in particular to provide a furniture element that has the qualities inherent to a cushion in terms of deformability and comfort (without reference here to the shape), while being easy to store, transport and convert from a use condition with a nominal volume, to a storage or transportation condition with a reduced volume, while being simple and economical to manufacture.

To this end, the present invention provides a furniture element, characterized in that it comprises a first flexible inner envelope defining therein a first volume adapted to receive a material comprising a fluid with a first density and a second flexible outer envelope, the inner envelope and the outer envelope defining together a second volume surrounding the first volume and containing a second material comprising a fluid and flexible particles with a second density higher than the first density, a first closable port for entry or exit of fluid into/from said first volume, opening to the outside, and a second closable port for the entry or exit of fluid into/from said second volume, opening to the outside.

Optionally are further provided the following features are provided, considered individually or in any technically possible combination:

- the two envelopes are locally attached to each other.
- the two envelopes are made of a flexible weldable synthetic material, the two envelopes being locally welded to each other.
- the two envelopes are welded in the opposite regions of the element.
- the inner envelope is made of panels assembled so as to provide thereto a general shape when a pressure prevails in the first volume.
- the outer envelope is formed of panels assembled so as to provide thereto a general shape similar to that of the outer envelope.
- the first port is located in a region where the two envelopes are attached to each other, so as to simultaneously extend through both envelopes.
- the first material is a gas.
- the first material comprises a material with a high compression/expansion ratio so as to make the first volume at least partially self-inflating when the first port is open.
- the second material comprises a mixture of gas and particles.
- the particles comprise a mixture of foam chips and fibers.
- the average particle size is between 5 and 30 mm.
- a grid is associated with the second port to prevent the escape of the particles when said port is open.
- the element further comprises a third port between the second volume and the outside, allowing the injection of the mixture of gas and particles therethrough and the discharge of excess gas through the second port.
- a one-way valve is associated with the third port.
- the element further comprises a third envelope forming a cover envelope removably surrounding the second envelope.

According to a second aspect, there is provided a method of compacting an element as defined above, characterized in that it comprises the following steps:

- extracting from the first volume substantially all of the fluid contained therein, and
- extracting from the second volume substantially all of the fluid contained therein while leaving therein said flexible particles.

It is also provided a method of bringing into usage an element as defined above, wherein the second material comprises a mixture of gas and particles, characterized in that it comprises the following steps:

- injecting a fluid into the first volume, and
- bringing the second volume into communication with the atmospheric pressure.

Finally there is provided a method of manufacturing and compacting an element as defined above, wherein the second material comprises a mixture of gas and particles and the element further comprises a third port between the second volume and the outside, characterized in that it comprises the following steps:

- manufacturing the two envelopes,
- injecting a mixture of gas and flexible particles into the second volume through the third port, while allowing excess gas to escape through the second port,
- closing the third port, and
- extracting gas from the second volume by application of a vacuum source, while leaving said flexible particles therein.

BRIEF DESCRIPTION OF THE DRAWINGS

Other aspects, aims and advantages of the present invention will appear more clearly from the following detailed description of a preferred embodiment thereof given by way of example and with reference to the accompanying drawings, in which.

DETAILED DESCRIPTION OF AN EMBODIMENT

Figure 1:
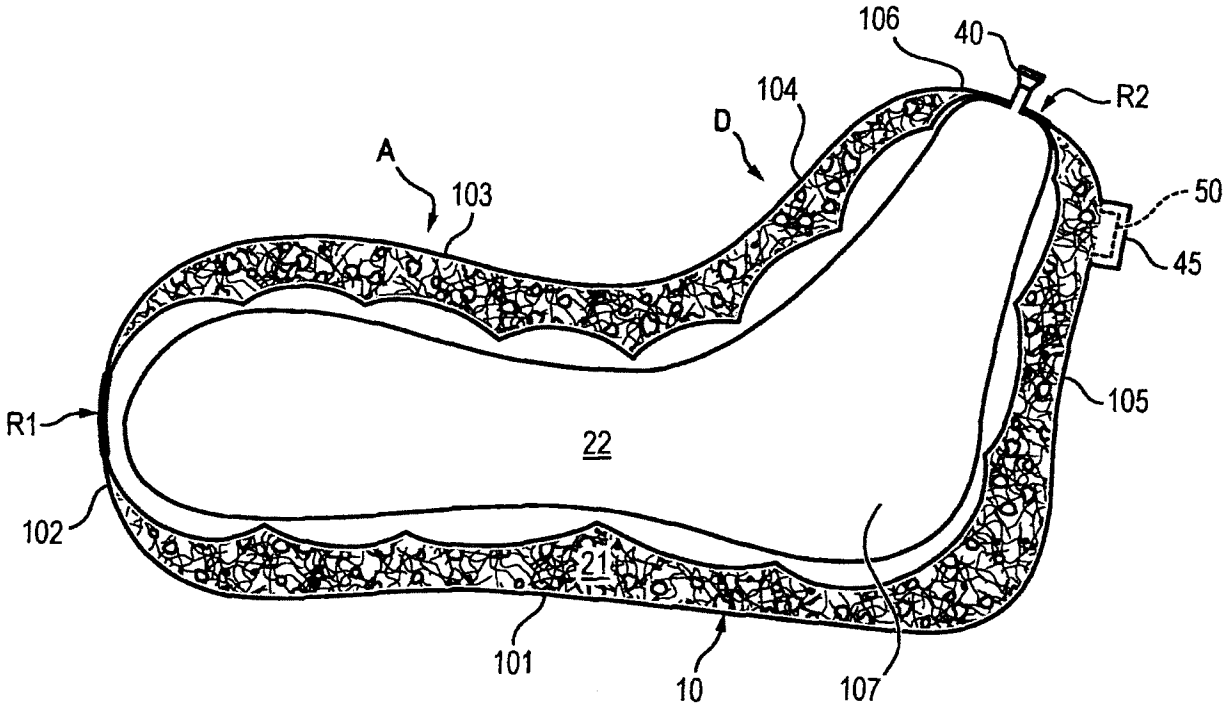
FIG. 1 is a longitudinal sectional view of an example of a seat according to the invention.
Figure 2:
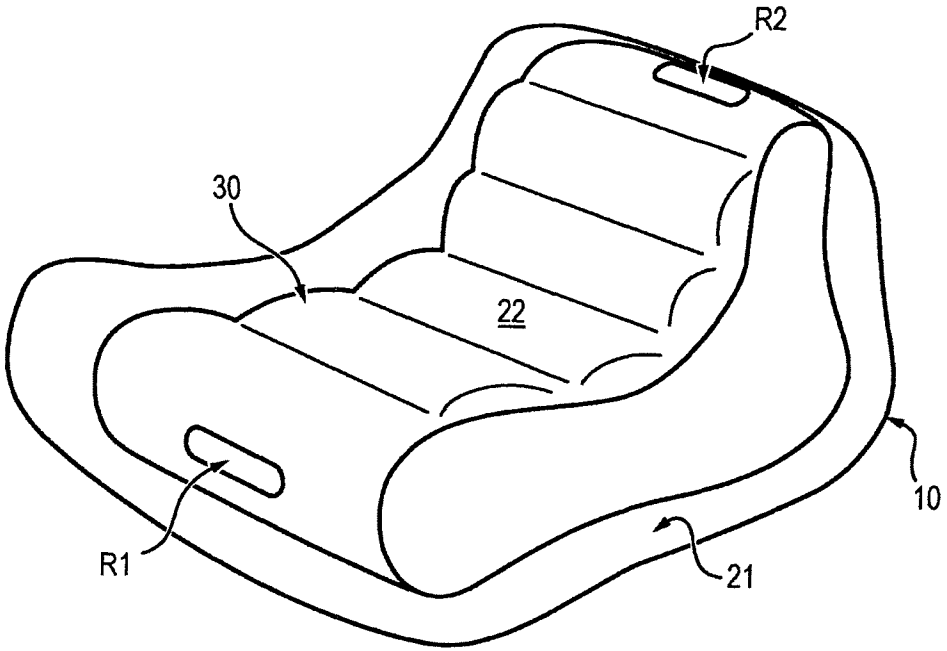
FIG. 2 is a perspective view of the seat of FIG. 1, and FIGS. 3 and 4 are perspective views from the back of two details of the back of a seat according to the invention, FIG. 3 showing an inner envelope and FIG. 4 showing an outer envelope.

Referring to FIGS. 1 and 2, there is shown a furniture element in the form of a chair-type seat with a seating portion A and a backrest D.

An outer envelope 10 defines the overall shape of the seat, with a ground-bearing area 101, a front zone 102, a seating zone 103, a backrest zone 104, a backrest top zone 106, a back zone 105 and two lateral zones, one 107 being shown in the sectional view of FIG. 1. The material of outer envelope 10 is a flexible membrane, preferably weldable and airtight, in particular made of PVC.

Inside the outer envelope 10 is provided an inner envelope 30, in an airtight and weldable material such that a PVC membrane. This envelope 30 separates the space 20 generally defined by the inner envelope 10 into a first, inner volume 22 delimited by said envelope 30 and a second, outer volume 21, substantially entirely surrounding inner volume 22.

The inner envelope 30 is connected to the outer envelope 10 in a limited number of regions, and in this example in two regions, namely a region R1 located in the front portion 103 and a region R2 located in the backrest top portion 106. In general, connecting regions are provided as a function of the desired shape for the element, so as to leave a significant freedom of shape for the outer envelope 10 relative to the shape of the inner envelope 30, as discussed in the following. Generally, two connecting regions in opposite parts of the element shall be provided. The connection between the two envelopes is preferably carried out by welding the membranes to secure them together on an area of the order of 50 to 500 cm2.

On is noted that the shape of the inner envelope 30 in the inflated state (as will be detailed later) is obtained by welding together a plurality of panels of particular shapes (in this case two panels, a top panel and a bottom and rear panel), and by optionally providing the panels, in particular the top panel and the bottom and rear panel, with stiffening lines (extra thickness of material), in a manner known per se in the field of inflatable mattresses and other leisure items. Similarly, the outer envelope 10 can be made by welding together a number of panels, with a general shape similar to that of the inner envelope, and a larger size (typically 20 to 50% larger).

Figure 4:
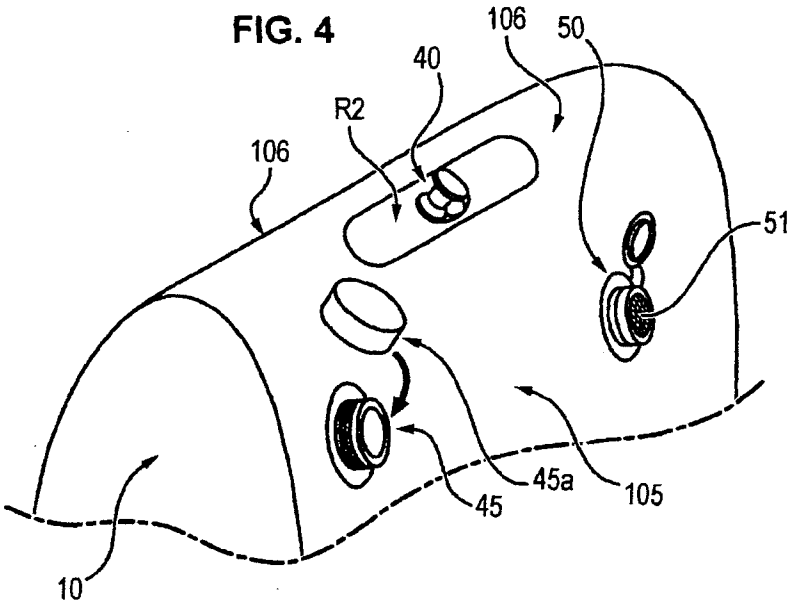
Figure 3:
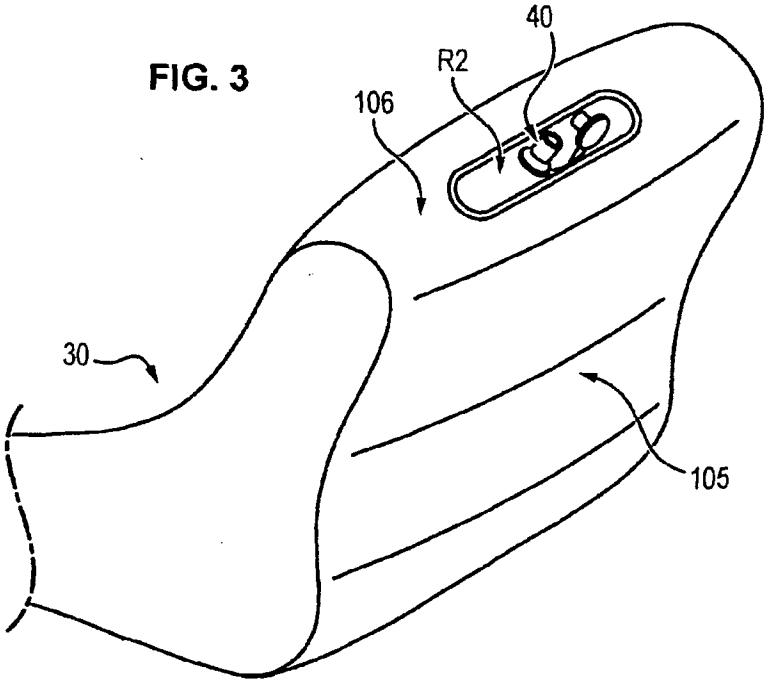

As better seen in FIGS. 3 and 4, the inner volume 22 communicates with the outside through a sealing cap, for example of the inflation connector type as used in the above field of pneumatic articles, the cap 40 preferably being located within one of the regions R1 and R2 so as to simultaneously pass through the material thickness of the outer envelope 10 and the material thickness of the inner envelope 30. This cap allows applying an adjustable air or other gas pressure to the inner volume 22, and almost completely emptying this inner volume. The cap 40 preferably comprises a one-way valve, in a manner known per se. In addition, a relief valve (not shown) can be provided in the inner envelope 30 so as to avoid an accidental bursting of membrane 30.

The outer volume 21 communicates with the outside through at least one cap, preferably a sealing screw cap 50 of a section typically comprised between 10 and 30 $cm^2$, provided with a grid 51, the size of the openings of which is dimensioned to prevent the escape of the particles, for reasons explained below. This cap is preferably located in the back zone 105 of the seat so as to avoid discomfort.

In a preferred embodiment, and as discussed below with reference to FIG. 4, two caps are provided, both located in the back zone 105 so as not to create discomfort.

To manufacture the seat, a structure such as the one as shown in FIGS. 1 and 2 is made, the outer volume 21 is filled with a filler material, either through the opening of cap 50, or prior to closing the envelope 10 (for example by stitching).

In a preferred embodiment, the filler material is a particulate material, and the particles comprise a mixture (preferably about 50/50) of foam chips e.g. made of polyester and fibers e.g. made of polyester. The average particle size is preferably comprised between 5 and 30 mm. Alternatively to one or the other of these types of particles, or in addition thereto, microbeads of expanded polystyrene can be provided. Such a mixture allows both guaranteeing an excellent comfort and ensuring that the mobility of the particles in the second volume is not too large (with an area possibly becoming entirely devoid of particles), or not too low (the feature of shape variability in particular as a function of the posture of the occupant being important especially in the case of large cushions or patio or pool seats).

In the case where the filler material is particulate (foam chips, fibers, microbeads, etc.), the filling is preferably carried out by injection in a stream of air or other gas. In this case, the outer envelope material 10 is for example a woven or nonwoven material that allows air to pass through easily, but whose openings are much smaller than the size of the filler material particles.

As mentioned above and illustrated in FIG. 4, it can be provided that the outer envelope 10 is equipped with two caps, with a cap 45 for filling upon manufacture, having an unobstructed passage sufficiently large (typically around 10 to 30 $cm^2$) for injecting the particles in an air stream, and the other 50 optionally with a smaller passage section, having a grid 51 as mentioned above with openings allowing the exit of the injected air while preventing the exit of the introduced particles. The caps 45 and 50 are preferably screw caps, and the cap 45 is equipped with a one-way valve preventing any risk of exit of the filling material when the cap is unscrewed.

Then, the cap 50 or the caps 45 and 50 being closed, the inner volume 22 is filled with air by means of a filling connector (not shown) sealingly connected to cap 40. This can be done either by mouth or with a manual or motorized inflator.

The inflation pressure determines the rigidity and the "softness", and can be adjusted to any desired value without exceeding a certain limit.

Once these operations are completed and the caps are closed, the assembly is preferably placed in a cover or dress envelope with selected material and color (typically a heavy canvas fabric of polyamide or polyester, of leather, etc.) and the seat is ready for use.

It is understood that due to the fact that a substantial proportion of the inner space of the seat is filled with air or other gas, the weight of the seat is significantly reduced while it retains qualities comparable or even superior (adjustable stiffness) to those of a seat entirely filled with particulate material.

For transporting the seat, either upon marketing or after purchase, the inner volume 22 is emptied of its air, either by pressing on the seat after opening cap 40, or by connecting a vacuum pump, then the cap is preferably closed to avoid a new air intake. This allows a decrease of the seat volume substantially corresponding to the inner volume 22. Typically, depending on the configuration and volume of the inner space and the outer space, a reduction in volume of 25 to 50%, typically of around 35%, can be achieved.

In the case where the filler material is a particulate material, vacuum can also be applied to the outer volume 21 so as to further reduce the volume of the seat for transportation. In this case, the grid provided in the cap 50 allows applying a vacuum pump without the risk of removing filler material.

This leads to an additional volume gain which can be from 5 to 15% of the total volume in use, depending in particular from the type of particles and the density at which they have been placed in the outer volume.

After delivery, air is re-injected into the inner volume 22 and possibly in the outer volume and the furniture element can be used after putting the cover in place or back in place.

It is noted that the fact that the outer envelope 10 and the inner envelope 30 are connected to each other at a limited number of connecting regions allows keeping a great freedom of shape, the material located in the outer volume 21 being capable of moving (more or less spontaneously depending on the nature of the material) as a function of the various constraints (gravity, pressure exerted by the user).

Of course, the present invention may be subject to various variants and modifications, and in particular:

- the element may include several inner volumes and/or several outer volumes, especially depending on shape, comfort and strength considerations; in this case, the inner volumes may or may not communicate with each other, so as to equalize their pressures or not;
- the filler material may be of different natures: microbeads, synthetic fibers, foams, gels, made of suitable materials such as polyester, expanded polystyrene, etc. or any mixture of these elements. One can also provide different filler materials, and/or different filling densities, in different volumes or compartments, depending on the considered portion of the furniture element at stake (seat cushion, seat backrest, etc.);
- the material filling the inner volume 22 may be either a fluid, typically air or more generally a gas, or a liquid such as water, of a material with high compression/expansion ratio so as to provide the first volume with an at least partially self-inflating character when cap 40 is open;
- the layout and the nature of the filler for the different volumes allows providing the furniture element with any desired shape and structure, being noted that the shape and arrangement of the membrane(s) delimiting the air volume(s), combined with the prevailing air pressure, is a major factor of structuration.
- the element may comprise different parts assembled together (by stitching, zippers, snap fasteners, Velcro®, etc.) permanently or removably;
- partitions can be provided, which in certain locations connect the outer envelope 10 to the inner envelope 30 along the thickness of the peripheral volume, so that the inner volume 22 is brought to the desired position in the seat;
- in the connecting regions between the inner envelope 30 and outer envelope 10, this connection may optionally be separable (Velcro®, etc.).

The invention is particularly applicable to large volume seat-type or cushion-type elements (typically from 0.2 to 1 $m^2$) for outdoor use (terraces, swimming pools).

The invention claimed is:

1. A furniture element, comprising a first flexible inner envelope defining therein a first volume adapted to receive a first material comprising a fluid with a first density and a second flexible outer envelope, the inner envelope and the outer envelope defining together a second volume surrounding the first volume and containing a second material comprising a mixture of gas and flexible particles with a second density higher than the first density, a first closable port for entry of fluid into said first volume or exit of fluid from said first volume, opening to the outside, a second closable port for the entry of gas only into said second volume or exit of gas only from said second volume, opening to the outside, and a third port between the second volume and the outside, allowing the injection of the mixture of gas and flexible particles therethrough and the discharge of excess gas through the second port.

2. An element according to claim 1, wherein the two envelopes are locally attached to each other.

3. An element according to claim 2, wherein the two envelopes are made of a flexible weldable synthetic material, the two envelopes being locally welded to each other.

4. An element according to claim 3, wherein the two envelopes are welded in the generally opposite regions of the element.

5. An element according to claim 2, wherein the inner envelope is made of panels assembled so as to provide thereto a general shape when the first volume is pressurized.

6. An element according to claim 5, wherein the outer envelope is made of panels assembled so as to provide thereto a general shape similar to that of the outer envelope.

7. An element according to claim 2, wherein the first port is located in a region where the two envelopes are attached to each other, so as to simultaneously extend through both envelopes.

8. An element according to claim 1, wherein the first material is a gas.

9. An element according to claim 1, wherein the first material comprises a material capable of self-expansion when the first port is open, so as to make the first volume at least partially self-inflating.

10. An element according to claim 1, wherein the second material comprises a mixture of gas and particles.

11. An element according to claim 10, wherein the particles comprise a mixture of foam chips and fibers.

12. An element according to claim 11, wherein the average particle size is between 5 and 30 mm.

13. An element according to claim 10, wherein a grid is associated with the second port to prevent the escape of the particles when said port is open.

14. An element according to claim 1, wherein a one-way valve is associated with the third port.

15. An element according to claim 1, further comprising a third envelope forming a cover envelope removably surrounding the second envelope.

16. A method for compacting a furniture element, comprising a first flexible inner envelope defining therein a first volume adapted to receive a first material comprising a fluid with a first density and a second flexible outer envelope, the inner envelope and the outer envelope defining together a second volume surrounding the first volume and containing a second material comprising a mixture of gas and flexible particles with a second density higher than the first density, a first closable port for entry of fluid into said first volume or exit of fluid from said first volume, opening to the outside, a second closable port for the entry of gas into said second volume or exit of gas from said second volume, opening to the outside, and a third port between the second volume and the outside, allowing the injection of the mixture of gas and flexible particles therethrough and the discharge of excess gas through the second port, the method comprising the following steps:

extracting from the first volume substantially all of the fluid contained therein, and extracting from the second volume substantially all of the fluid contained therein while leaving therein said flexible particles.

17. A method of bringing into usage a furniture element, comprising a first flexible inner envelope defining therein a first volume adapted to receive a first material comprising a fluid with a first density and a second flexible outer envelope, the inner envelope and the outer envelope defining together a second volume surrounding the first volume and containing a second material comprising a mixture of gas and flexible particles with a second density higher than the first density, a first closable port for entry of fluid into said first volume or exit of fluid from said first volume, opening to the outside, a second closable port for the entry of gas into said second volume or exit of gas from said second volume, opening to the outside, and a third port between the second volume and the outside, allowing the injection of the mixture of gas and flexible particles therethrough and the discharge of excess gas through the second port, the method comprising the following steps:

injecting a fluid into the first volume, and bringing the second volume into communication with the atmospheric pressure.

18. A method of manufacturing and compacting a furniture element, comprising a first flexible inner envelope defining therein a first volume adapted to receive a first material comprising a fluid with a first density and a second flexible outer envelope, the inner envelope and the outer envelope defining together a second volume surrounding the first volume and containing a second material comprising a mixture of gas and flexible particles with a second density higher than the first density, a first closable port for entry of fluid into said first volume or exit of fluid from said first volume, opening to the outside, a second closable port for the entry of gas into said second volume or exit of gas from said second volume, opening to the outside, and a third port between the second volume and the outside, allowing the injection of the mixture of gas and flexible particles therethrough and the discharge of excess gas through the second port, the method comprising the following steps:

manufacturing the two envelopes, injecting a mixture of gas and flexible particles into the second volume through the third port, while allowing excess gas to escape through the second port, closing the third port, and extracting gas from the second volume by application of a vacuum source, while leaving said flexible particles therein.

* * * * *